US005165260A

United States Patent [19]

Geiger

[11] Patent Number: 5,165,260

[45] Date of Patent: Nov. 24, 1992

[54] WASHING-MACHINE

[75] Inventor: Peter Geiger, Balingen, Fed. Rep. of Germany

[73] Assignee: BSG-Schalttechnik GmbH & Co., KG, Balingen, Fed. Rep. of Germany

[21] Appl. No.: 635,179

[22] PCT Filed: Apr. 27, 1990

[86] PCT No.: PCT/EP90/00681

§ 371 Date: Jan. 3, 1991

§ 102(e) Date: Jan. 3, 1991

[87] PCT Pub. No.: WO90/13698

PCT Pub. Date: Nov. 15, 1990

[30] Foreign Application Priority Data

May 3, 1989 [DE] Fed. Rep. of Germany ..... 3914644

[51] Int. Cl.[5] ..... D06F 33/02

[52] U.S. Cl. ..... 68/12.04; 68/12.06

[58] Field of Search ..... 68/12.06, 12.03, 12.04, 68/12.18

[56] References Cited

U.S. PATENT DOCUMENTS 3,013,421 12/1961 Buss ..... 68/12.03
3,088,593 5/1963 Stilwell, Jr. ..... 68/12.06 X
4,159,211 6/1979 Hoffman ..... 68/12.23 X
4,663,948 5/1987 Rummel ..... 68/12.23 X

FOREIGN PATENT DOCUMENTS 61-98289 5/1986 Japan ..... 68/12.04
62-192196 8/1987 Japan ..... 68/12.03
2202646 9/1988 United Kingdom ..... 68/12.04

*Primary Examiner*—Frankie L. Stinson
*Attorney, Agent, or Firm*—Darby & Darby

[57] ABSTRACT

In connection with a machine for the treatment of laundry, in particular a washing-machine or drier, comprising weight sensors for automatic measurements of the weight of the laundry and subsequent determination of the quantities of treatment agents to be filled in (water, detergents, or the like), for determining the relative humidity content, for detecting and removing imbalance conditions, it is proposed to arrange a decoupling frame between an outer housing resting on a stationary supporting surface, and the entire inner system of the washing-machine or dryer, including the lye tank with drum and other partial components, the decoupling frame being itself resiliently suspended in the outer housing and supporting all the other components, and to provide weight sensors, preferable resistance strain gauges, which coact with the resilient suspension of the decoupling frame.

17 Claims, 5 Drawing Sheets

WASHING-MACHINE

BACKGROUND OF THE INVENTION

The present invention relates to a machine for the treatment of laundry, such as a dryer or washing-machine.

A known washing-machine of this kind (DE-PS 30 25 088) has the drum supported for rotation in the lye tank, while the lye tank is supported in a suitable manner on the bottom of the housing, via resilient and, in certain cases, damping supports. The drum is supported in the lye tank in the usual manner, namely in unilaterally overhung arrangement, by means of a star-shaped mounting bracket fastened undetachably to the back of the lye tank by means of a plurality of screws and fish-plates. The arms of the star-shaped mounting bracket extend right to the peripheral areas of the lye tank, and may even reach around the latter, for improved solidity, as the drum, being heavily loaded with wet laundry in the operating condition of the machine, has a pronounced tendency to tilt in the hub area of the star-shaped mounting bracket where it is held by only one double bearing.

In order to provide such a mechanical arrangement with a suitable measuring system which on the one hand permits the increasing weight caused by the laundry being filled in to be recorded and evaluated automatically and which on the other hand operates with sufficient accuracy, electromechanical transducers are arranged on those parts of the star-shaped mounting brackets which are exposed to particularly pronounced stresses under the effect of the drum weight. The weight-proportional output signals supplied by these electromagnetic transducers, for example resistance strain gauges or piezoelectric transducers mounted firmly in the material of the star-shaped mounting bracket, are then transmitted to a signal-processing arrangement which is thereby enabled, for example, to evaluate the weight of the laundry filled in and to derive therefrom automatically the liquid level in the lye tank and to adapt it as required.

This publication (DE-PS 30 25 088) clearly recognizes, and explains with reference to other publications likewise dealing with the problem of recording the weight of laundry (U.S. Pat. No. 2,412,270; DE-AS 11 57 578; DE-OS 20 34 847) that sufficient accuracy, initially only with respect to the weight of the laundry, can be achieved only under certain particular conditions. The problems connected with the determination of the weight have been seen heretofore in the fact that, regardless of the type of measuring sensor used, the dead weight of the washing machine (for example 100 Kg) makes it impossible for the usual increase in weight resulting from the dry laundry (approx. 0.5 to 5 Kg) to cause effects important enough for being determined with sufficient accuracy for use in an automatic control circuit.

In setting out this theory, DE-PS 30 25 088 disregards, however, at least in part the main reason for the measuring inaccuracies namely that all measuring processes previously employed are affected by excessive frictional influences so that these, and the hysteresis produced by such frictional influences, are already sufficient reason that no exact results can be expected for the desired weight measurements. While such accuracies are already critical in determining the weight of the laundry, and the water level to be derived therefrom, they make such measurements absolutely useless if one tries to determine automatically the quantity of detergents to be added, including the quantities of fabric softeners, special detergents, and so on, and to use for this purpose automatic control circuits, including in particular minicomputers and microprocessors with corresponding storage capacities, and the like, which are currently in use today, and this although such program-controlled operation would be so very important today, especially under the aspects of environmental protection.

The same is true for the solution proposed by DE-PS 30 25 088 which does not itself even expect a better accuracy than a resolution of approx. 0.1 Kg (column 3, line 4, of the quoted patent specification).

However, such measuring inaccuracies can by no means be accepted in determining the quantities of detergents to be added, as in this case an accuracy in the gram range would be required because in the case of a predetermined detergent quantity of 20 gram an extra of only 5 gram would already mean that the prescribed quantity has been exceeded by 25%.

This is in fact the reason why all solutions proposed heretofore, including the solutions contained in DE-OS 34 13 967, GB-2 087 438 A and EP 0294014 A1, cannot achieve acceptable results in practical application although the addition of detergent quantities has been discussed in most of these publications, and program sequences and fully-automatic program controls have in fact been proposed in this connection for different operations, including the addition of detergent quantities adapted to the weight of the laundry.

It should be noted, however, in this connection that the drum-type washing-machine disclosed by DE-OS 34 13 967 only had for its purpose to ensure that the quantity of laundry filled into the washing-machine actually corresponds to the capacity of the drum, i.e. to avoid errors that may result from a mere estimation of the weight of the laundry and which may lead to the drum being either not used to full capacity or being overloaded in which case the laundry will not be cleaned as thoroughly as desired. In order to simplify the step of determining the correct quantity of laundry, the discussed publication proposes to design the upper cover plate of the washing-machine as scales comprising a display where the operator can read the correct laundry weight. Additionally, the result of the weighing operation may also be employed for varying the program of the washing-machine, for which purpose the weighing system can be coupled with the program control of the washing-machine. Except for these aspects, the publication does not propose to take other actions on the program sequence or the loading quantities.

In contrast, the arrangement of the washing-machine described by British Patent Application GB-2 087 438 A is such that liquid-filled weight sensors operating on a piezoelectric/resistive basis are mounted at the lower mounting points of supports of the drum and/or its container, such supports taking the form of hydraulic shock absorbers, for example. The output signals of the weight sensors are then transmitted to a central control circuit, for example in the form of a program-controlled microprocessor, which is said to be capable of determining the quantity of detergent to be added.

However, it is a common problem of these known "weight-determining" washing-machines, including the machines which will be described further below, that the weight sensors, regardless of their shape and design, are always arranged either in the area of the feet of the entire housing of the washing-machine, or in the area of the hydraulic suspension of the lye tank or the drums, so that the hydraulic properties of these elements are always included, or have to be included, in the measurements. In addition, and this is a very important fact, though not mentioned at any point of the publication, the influence of the supply hoses and in particular the rubber seal in the area of the door of the drum is also disregarded. However, these aspects alone already cause errors so important that—in particular if one additionally considers the frictional influences usually dependent on the prevailing temperatures and/or environmental conditions (wet or dry rubber seal of the door)—the measuring results achievable from time to time are not even sufficiently accurate to guarantee an at least approximate determination of the weight of the laundry, not to speak of the desirable metering accuracy in the gram range for the detergent quantities to be added. Finally, it has been known in connection with a washing-machine (EP 0294014 A1) to arrange weight sensors in the area of the resilient drum suspension, for supplying a microprocessor controlling the program sequence and in particular the spinning operations of the washing-machine with signals representative of dynamic weight variations resulting from imbalance conditions occurring during the spinning operation. Such signals are then compared with predetermined threshold values, and when the latter are exceeded either the spinning operation is stopped, or the acceleration of the spinning motor is interrupted for a certain period of time. Similar measures have been known also from CH-PS 651 602.

Generally, it can be said that when washing-machines are operated on the basis of minicomputers or microprocessors with controlled program sequences, the sequence control has to rely on data supplied by sensors in order to be able to control the operation of the washing-machine properly, from the first start-up and the initial introduction of the required water quantity, up to the final spinning operation. Such sensors are more and more becoming the weakest element in the processing chain, and this not only because, being actual value transmitters, they get into direct contact with the agents to be measured, but also because the ever progressing degree of electronic equipment in washing-machines permits ever higher accuracies to be achieved—a requirement which cannot, however, be met by today's actual-value transmitters. For example, it is already a problem with washing-machines to adjust the water level in the drum precisely to the level determined by the program in order to ensure on the one hand that the machine does not consume too much water—this already for environmental reasons—and on the other hand that the washing program will work as desired. The water level reached at any time is usually measured with the aid of level sensors, level pick-ups or pressure cells which are exposed to the water unilaterally. However, all these elements are connected with the disadvantage that trouble caused by dirt, furring, or the like may develop especially in the area of such elements, in particular after an extended service life of the washing-machine, and in addition the actual-value information supplied by such sensors is not always sufficiently accurate.

Further, it is desirable for the purposes of a washing-machine that the central control circuit be supplied with an initial information regarding the quantity of laundry filled into the washing-machine so that the circuit may then compute the required water quantity, based on such information, control the water supply and determine, and automatically add, the desired detergent quantities.

There is, therefore, a demand for a highly precise and, above all, robust level-measuring system for washing-machines which is capable of supplying data from which the computer installed in the washing-machine can derive the necessary metering steps automatically.

Now, it is the object of the present invention to specify a filling-quantity measuring system for a washing-machine which is particularly precise, gives reproducible measurements and which is, above all, resistant to aging and can be used universally, and which not only determines the quantity of the laundry filled in, but supplies a central control circuit with all actual values required for ensuring precise program operation and proper control of the filling levels.

ADVANTAGES OF THE INVENTION

The invention provides the advantage that the highly precise measurement of all weight data of interest, which is now rendered possible by the invention, ensures on the one hand perfect operation of the washing-machine and the highest degree of consideration of environmental aspects, while eliminating at the same time the need for all the other outer sensors, level indicators, and the like previously required by such washing-machines.

In the case of the washing-machine according to the invention, once the laundry has been introduced and measured exactly, the program is capable of determining not only the liquid level for the different washing programs, but also the quantity of water to be added, by weighing the latter. So, it is now possible to preset continuously any desired liquid levels in the lye tank, combined with the addition of the required quantities of detergents of any type and origin, i.e. liquid or in powder form, the detergent quantity added being also measured by weighing. A washing-machine operating according to the parameters of the present invention is, therefore, capable of cleaning laundry in a particularly economic, and on the other hand in a particularly effective way, as the laundry in the washing-machine is always treated exactly with those quantities of water and detergents which have been found to give optimum cleaning results. The invention, therefore, avoids all imaginable estimations of values which heretofore normally caused the operators to add excessive quantities of detergents, in order to be on the safe side, but sometimes also because they did not know the detergent quantities actually required, or else because the quantities indicated, for example by the detergent manufacturers, naturally had to be little accurate as the detergent manufacturer also had no means of predicting exactly the weight of the laundry in the washing-machine.

It is, therefore, regarded as a particular advantage of the present invention that the operator only has to inform the control circuit of the washing-machine at the beginning of the washing operation what sort of laundry is to be treated (white linen, colored linen, woolen clothes, or the like) and, for example, what relative degree of dirtiness has to be considered—the rest will then be done by the washing-machine, due to the extensive program structure provided by the programming of the machine, which is capable of allowing for even extreme items and of operating with high precision, thanks to the highly precise actual-value measurements of all filling quantities of interest, which are ensured by the present invention.

The invention succeeds in this respect in eliminating fully all frictional influences which heretofore always led to non-reproducible or generally useless weight data, in particular due to unpredictable hysteresis effects. The use of a particular type of weight sensor is not critical in this connection, although resistance strain gauges are a preferred choice. However, other displacement/force pickups providing a corresponding output signal representative of a weight, such as piezoelectric systems, moving-coil systems, string balances, proximity switches, or the like, are also imaginable.

The common decisive element of all embodiments lies in the fact that a decoupling frame is provided between the outer housing and all interior arrangements of the washing-machine, which frame supports all mechanisms and components of the washing-machine, including the lye tank, the drum, the hydraulic supports, the door system, and so on, and which itself is suspended in the outer stationary housing via leaf springs, while the resistance strain gauges preferably used in this case are mounted on and fixed to the said leaf springs.

It being also possible, according to certain preferred embodiments of the invention, to implement the supply of the washing-machine system without hose connections, via an air gap, using suitable funnels and filling means, the decoupling frame remains really absolutely decoupled from all frictional influences which means that thanks to the advanced weighing technique (spring-leaf suspension with resistance strain gauges) it is actually possible to achieve measurements with an accuracy in the gram range, even if only a quantity equal to one or two tablespoons of some agent are needed for a rinsing operation or the like.

The resistance strain gauges employed are capable of supplying absolute and relative measurements, with accuracies of up to five decimal points of a measured value. Even if one assumes an initial weight of 100 Kg or so for the decoupling frame together with all interior installations of the washing-machine, the output signals representative of the actual weight. which can be achieved with the aid of the present invention, are actually determined with an accuracy in the gram range, it being further possible to employ circuits and converters of the known type in connection with such resistance strain gauges for evaluating the analog signals so obtained.

An analog-to-digital converter particularly well suited in this connection has been described by DE-PS 36 30 633 so that the measuring principle discussed there need not be explained here once more in full detail.

According to a preferred embodiment of the present invention, the sensors in the form of resistance strain gauges are arranged as part of a Wheatstone bridge, and the supply voltage of the bridge is an AC voltage, in order to avoid errors due to polarizing potentials.

In summary, it can therefore be said that the invention, while ensuring optimum environmental protection, achieves simultaneously optimum washing results, combined with reduced water consumption and precise metering of the consumption of detergents, it being only necessary for this purpose to use corresponding weight sensors and to have all agents necessary for carrying out a washing-process, including the hot or cold water, automatically supplied through correspondingly controlled valves or from a wash-in supply container comprising several chambers, if desired.

The features specified in the subclaims permit advantageous improvements and further developments of the invention. A particularly advantageous design of the washing-machine is achieved when the decoupling frame and at least the front face of the washing-machine, including the door opening mechanism, and the like, are designed as a single piece so that it is no longer necessary to leave a larger gap in the outer housing around the door opening in order to prevent the door from hitting against the housing in the event of more violent movements of the drum, for example during a spinning operation. Any influences on the weighing result by the door seal as such are anyway excluded as the lye tank, which is sealed by the door, also belongs to those components of the washing-machine which are supported by the decoupling frame and as in any case the door is not fastened to the outer housing of the washing-machine.

BRIEF DESCRIPTION OF THE DRAWING

Certain embodiments of the invention will now be described in more detail with reference to the drawing in which.

DESCRIPTION OF THE EMBODIMENTS

The basic idea of the present invention is seen in the fact that the entire inner system of a washing-machine is decoupled relative to the outer stationary housing, which rests on a base, by means of an additional decoupling frame and leaf-spring suspensions, thus rendering it independent in particular from frictional influences and enabling increases or decreases of the weight in the area of the drum and/or of the lye tank to be determined by suitable weight-measuring sensors, preferably in the form of resistance strain gauges, arranged on the leaf springs or coacting with the latter.

Considering the very high precision and resolution of resistance strain gauges that can be achieved today, this arrangement, in combination with the leaf-spring suspension, allows all processes of the washing-machine relating to filling quantities, including in particular the addition of detergents, to be controlled automatically.

Figure 1:
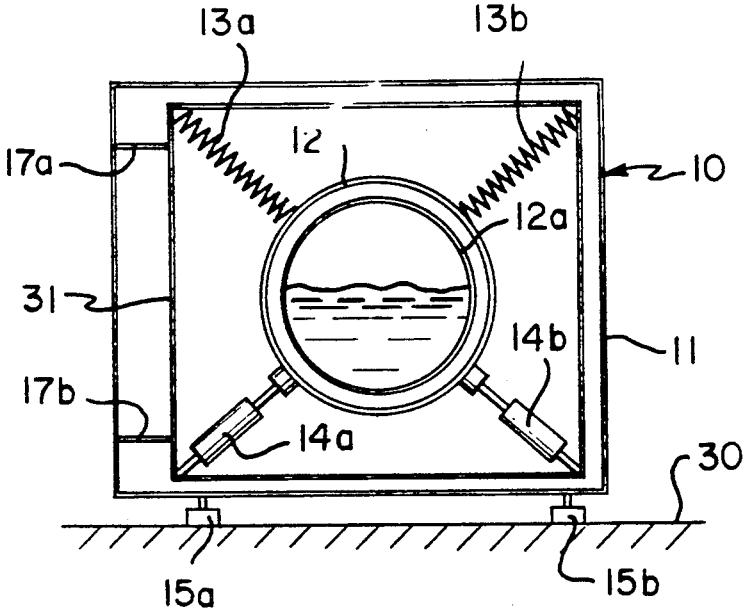
FIG. 1 is a very diagrammatic representation of the basic structure of one embodiment of a washing-machine according to the invention, comprising preferred embodiments of actual-weight value pickups in the form of resistance strain gauges mounted directly on the leaf springs which support the inner decoupling frame.

The washing-machine 10 illustrated very diagrammatically in FIG. 1 comprises an outer housing 11 resting in stationary relationship on a stationary support 30, for example by feet 15*a*, 15*b*. Inside the housing, there can be seen a carrier 31, which will be described hereafter as decoupling frame and which may, generally, have any desired shape. The carrier 31 as illustrated in FIG. 1 has the shape of a closed box, the depth of which may however be very small, so that such a decoupling frame 31 can be produced at low cost by welding together rails or profiled sections.

This inner carrier, or decoupling frame 31 then carries all the other components of the washing-machine or, to say it in other words, the entire washing-machine system, i.e. a drum 12*a* in its lye tank 12, the latter being in its turn supported inside the decoupling frame 31 in a suitable manner, for example via upper suspension springs 13*a*, 13*b* and lower supporting-/damping elements 14*a*, 14*b*. The particular design of the means by which the drum 12*a* is suspended and supported in and on the lye tank 12 is of minor importance. For example, such supporting means may well have the design of a suitable star-shaped mounting bracket by which the drum 12*a* may be mounted unilaterally in the lye tank.

Figure 2:
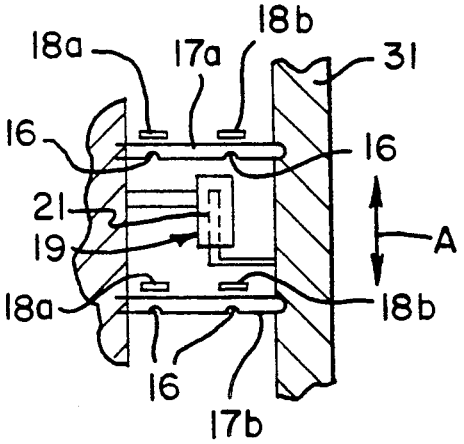
FIG. 2 shows another possible embodiment of an actual-value pickup for the weighing process.
Figure 3:
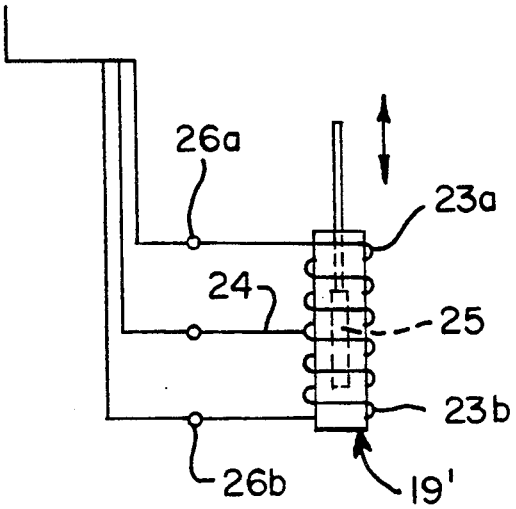
FIG. 3 is a larger, diagrammatic representation of the actual-value sensor in the form of a moving-coil pickup for the weight measurements.

The essential feature is seen in the fact that the carrier or decoupling frame 31 supporting the whole washing-machine system with all its necessary components, i.e. drive motor, belt pulleys, door for the drum with seal, and the like, is suspended, preferably only by one side, within the outer housing 11, preferably by means of leaf springs fixed at their two ends. In FIG. 1, the leaf springs 17*a*, 17*b* supporting and carrying the decoupling frame 31 are arranged between the neighboring left side walls—as viewed in FIG. 1—of the stationary outer housing 11 and the decoupling frame 31, and have both ends fixed, for example by welding, at the outer housing 11 and the decoupling frame 31, respectively. Consequently, the leaf springs 17*a*, 17*b* are fixed at both ends so that they will get distorted only very slightly, even when heavily loaded, as can be seen best in the representation of FIG. 2 which shows once more a detail view of the respective neighboring wall portions of the outer housing 11 and the inner decoupling frame 31. FIG. 2 further shows one possible special shape of the leaf springs, comprising upper and lower notches at predetermined points so that the leaf spring will react to variations of weight by distortions in the area of these notches, which distortions can be measured particularly efficiently by resistance strain gauges 18*a*, 18*b* which can be seen in the drawing above the notches 16. As an alternative solution, the representation of FIG. 2 further shows another weight-measuring arrangement 19 which may have the design described in more detail in FIG. 3 and which may consist, for example, of a differential coil 19' comprising two coil windings 23*a*, 23*b* separated by a center tap 24, and a ferrite core 25 which may occupy a central or zero position at the beginning of the measurement and which is driven by the movement to which the decoupling frame 31 is subjected by any variations in weight. The two outer connections 26*a*, 26*b* of the moving coil can then be supplied with a rf voltage, and the electric detuning resulting from the changes in position of the ferrite core 25 inside the moving coil then leads to variations of the analog signal which can be converted, just as in the case of the resistance strain gauges, by means of analog-to-digital converters and can then be supplied directly to a microprocessor for further processing.

Figure 4:
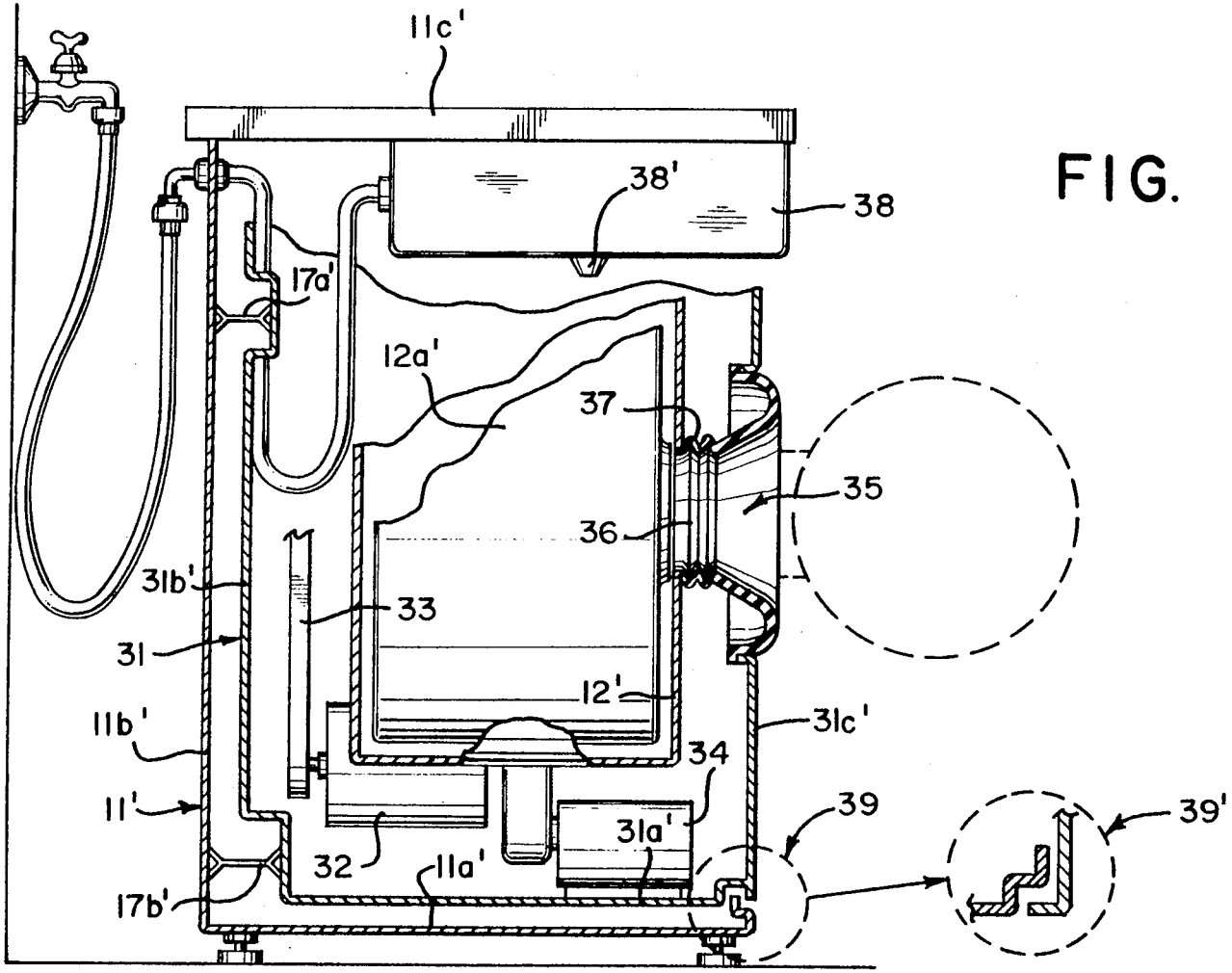
FIG. 4 is a larger representation of a detail of a preferred embodiment of a washing-machine, where the decoupling frame comprises the front plate of the washing-machine.

The structure of a washing-machine embodying the basic principle of the invention is shown in detail in FIG. 4. In the case of this embodiment, the stationary outer housing 11' can be completely open at the front, i.e. at the right in FIG. 4 where the door of the washing-machine is arranged, while the remaining outer wall portions, including the bottom 11*a'*, the rear wall 11*b'*, the upper top 11*c'* and the side walls not shown in the drawing are all in place. The forwardly open rectangular shape then encloses the decoupling frame 31, which may well do without any side or top walls and which may only consist of the portions illustrated in FIG. 4, i.e. a rear wall portion 31*b'*, a bottom wall portion 31*a'* and, in this case, a front 31*b'* replacing the missing front wall of the stationary outer housing 11'. One obtains in this manner a frame which is simply open at the top and which supports the whole washing-machine system including the drum.

Regarding now FIG. 4, one can see the inner drum 12*a'*, the drum tank 12' housing the drum 12*a'* and being supported in the decoupling frame 31' in a suitable manner not shown in detail, further a first drive motor 32 driving the drum via a belt 33, a lye pump 34 and a door mechanism 35.

The door seals the upper filling opening 36 of the lye tank 12' in a suitable manner, for example by means of a rubber compression seal 37, and is optionally fastened directly to the lye tank 12' or, if this should be desired or be more advantageous, in the usual manner to the visible front wall of the washing-machine, i.e. to the front wall 31*b'* of the inner decoupling frame 31'. This latter solution is also possible without any problems because the lye tank 12' is seated inside the decoupling frame 31' and mounted to the latter, in resilient relationship if required, so that the rubber seal 37 is subjected to relative movements during operation of the washing-machine, similarly to the conditions prevailing in usual washing-machines. On the other hand, however, it is ensured that these conditions do not lead to frictional influences on the measurements as—as has been explained before—it is the whole decoupling frame 31' which is suspended resiliently relative to the stationary outer housing 11', by means of the leaf springs 17*a'* and 17*b'* which are visible in this representation, too. Given the fact that the weight measurements are performed only on these leaf springs, any additional hose connections or means for introducing water or detergents, washing powder, fabric softeners, or the like, are not in any way disturbing in this connection, all these agents being washed in through a stationary wash-in or detergent container 38, which may also have several chambers, via an air gap, as can be seen best in FIGS. 5 and 6. As compared to this, the relative movements between the outer stationary housing 11' and the decoupling frame 31' are extremely small—to give a numerical value, which is however not meant to limit the invention, the displacement may amount to only 0.5 mm per 300 Kg of change in weight, a positional change which is nevertheless sufficient to permit a measuring accuracy in the before-mentioned gram range, due to the extreme sensitivity of modern resistance strain gauge systems.

It goes without saying that the front wall of the washing-machine and other parts belonging to the decoupling frame 31' are decoupled relative to the stationary housing 11', for example in the way illustrated in the transitional area 39 in FIG. 4, where neighboring wall edges adjoin each other in the form of a gap-type labyrinth seal.

If an open gap at the front is to be avoided, then it may also be recommendable to design the transition between the two adjoining wall edges in the manner illustrated by the detail 39'.

As regards the drain hose connected to the lye pump 34—a strainer is of course arranged inside the decoupling frame 31'—measuring problems can be avoided by running it in the form of a big loop, for example in the way illustrated for the supply hose in FIG. 4—a measure which as such is not necessary in the present case.

Figure 6:
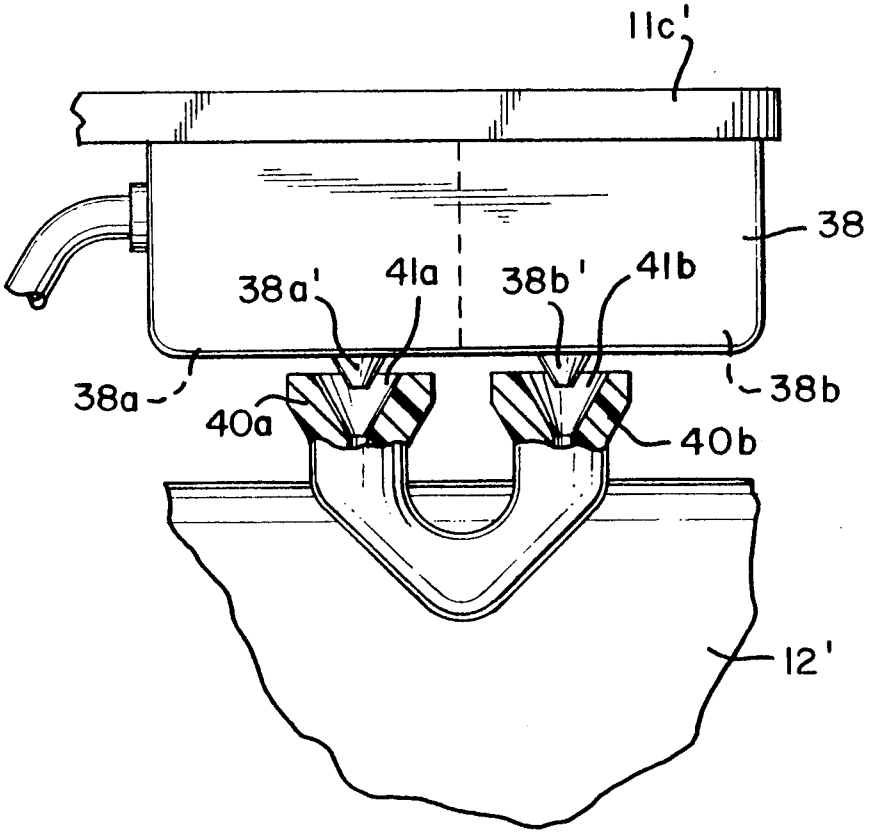
FIGS. 5 and 6 show front and side views of a metering unit which is fully decoupled from the washing-machine system which is suspended by means of the inner decoupling frame.
Figure 5:
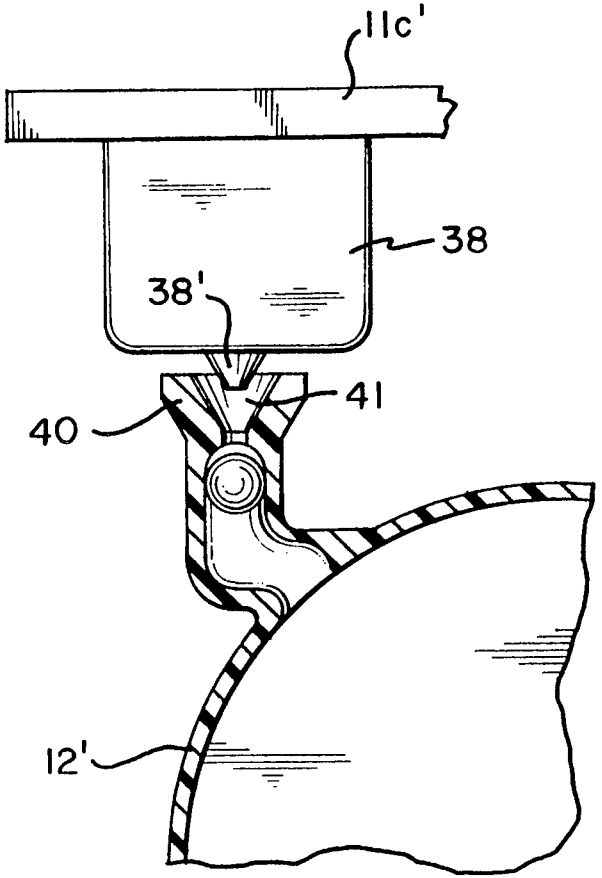

According to FIG. 5, a funnel-like protuberance or extension 40 of the lye tank 12' may be designed in such a way that the supply of water or detergents from the wash-in or detergent container 38 is effected via an air gap 41, defined by the distance between the upper open end of the funnel 40 at the lye container and a tapering outlet portion 38*a* of the container. The container may also comprise several chambers, as illustrated in FIG. 6, i.e. a first chamber 38*a* and a second or third and forth chamber 38*b*, etc., it being also possible to have the detergent washed in by the valve-controlled fresh water supply, if predetermined detergent quantities are filled into the wash-in and detergent container 38 from a larger supply container not shown in the drawing. This latter operation may be effected with the aid of any sort of metering arrangement, in the case of detergents in powder form for example by the use of a worm conveyor, or in the case of liquids by any other of the known highly precise metering arrangements. Alternatively, it is of course also possible to provide a supply container, preferably of a multi-chamber design, containing larger quantities of different washing ingredients, similar to the wash-in container 38, as a unit separate from the fresh water supply, in which case the transfer of the detergent quantities may also be effected by similar funnel arrangements with air gaps, whereas the supply of the respective detergent can be stopped, for example by means of a valve control, when the weighing arrangement signals that a pre-calculated quantity is reached. In this case, no separate metering arrangements are required for detergents in liquid or powder form. Such a detergent supply is also preferred because in most cases the lye container is anyway open towards the top so that the addition of washing agents, at different stages or positions in the washing cycle, can be realized most simply by a weight-dependent system.

It should be noted in this connection that the basic principle described above lends itself for application in the most variant forms in other machines for the treatment of laundry, for example in dryers where the decrease in relative humidity can be determined without any problem by weight measurements. In this case, one preferably proceeds in such a way that the dryer is caused to perform weight measurements at predetermined points in time—all inner components of the dryer are of course separated from the stationary outer housing in the described manner, by a decoupling frame—and that the degree of dryness is then derived from the curve shape of the relative decrease in weight, which approaches asymptotically a threshold value—a process which can be handled without any problem by the central control circuit (microprocessor), provided corresponding predetermined curve shapes have been stored. It is then also possible without any problem to determine those points in the known curve shapes where the degrees of dryness described as "completely dry" or "ready for ironing" have been reached.

Another advantageous application of the present invention is seen in the fact that the weight measurements also permit imbalance phenomena, which may occur during spinning operations in washing-machines, to be detected if certain threshold values are exceeded, and to initiate suitable measures for remedying such phenomena. The central control unit (microprocessor or minicomputer) determines to this end if the dynamic weight variations signaled by the resistance strain gauges during the spinning operations exceed certain threshold values, latter which can be fixed without any problem by previous measurements. If so, it is recommendable to either stop the spinning operation and/or to distribute the laundry more efficiently in the drum, which can be achieved by short rotating cycles of the drum with intermediate short reversing cycles, whereafter the spinning process can be re-started, and/or to emit an alarm if no improved conditions are obtained following a certain number of repetitions of this process.

Given the fact that the process of influencing spinning operations, including dynamic variations of weight, has been described as such by the before-mentioned publications (DE-OS 34 13 967, GB 20 87 438) it need not be described here once more in full detail.

Figure 7A:
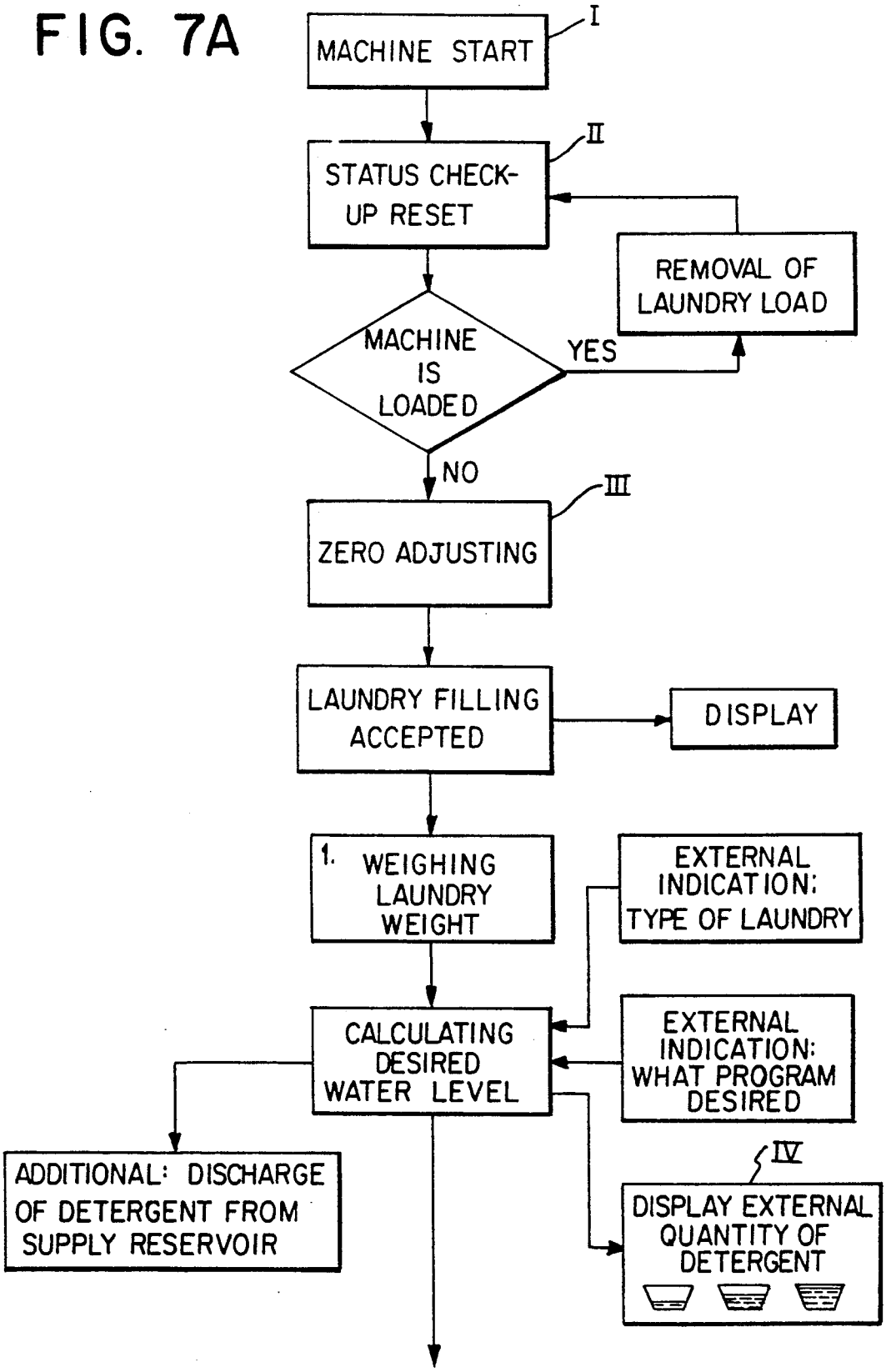
FIGS. 7A and 7B shows one possible embodiment of a flow diagram (functional sequence) for the operation of a washing-machine according to the invention, with a filling-quantity measuring feature using weighing processes.
Figure 7B:
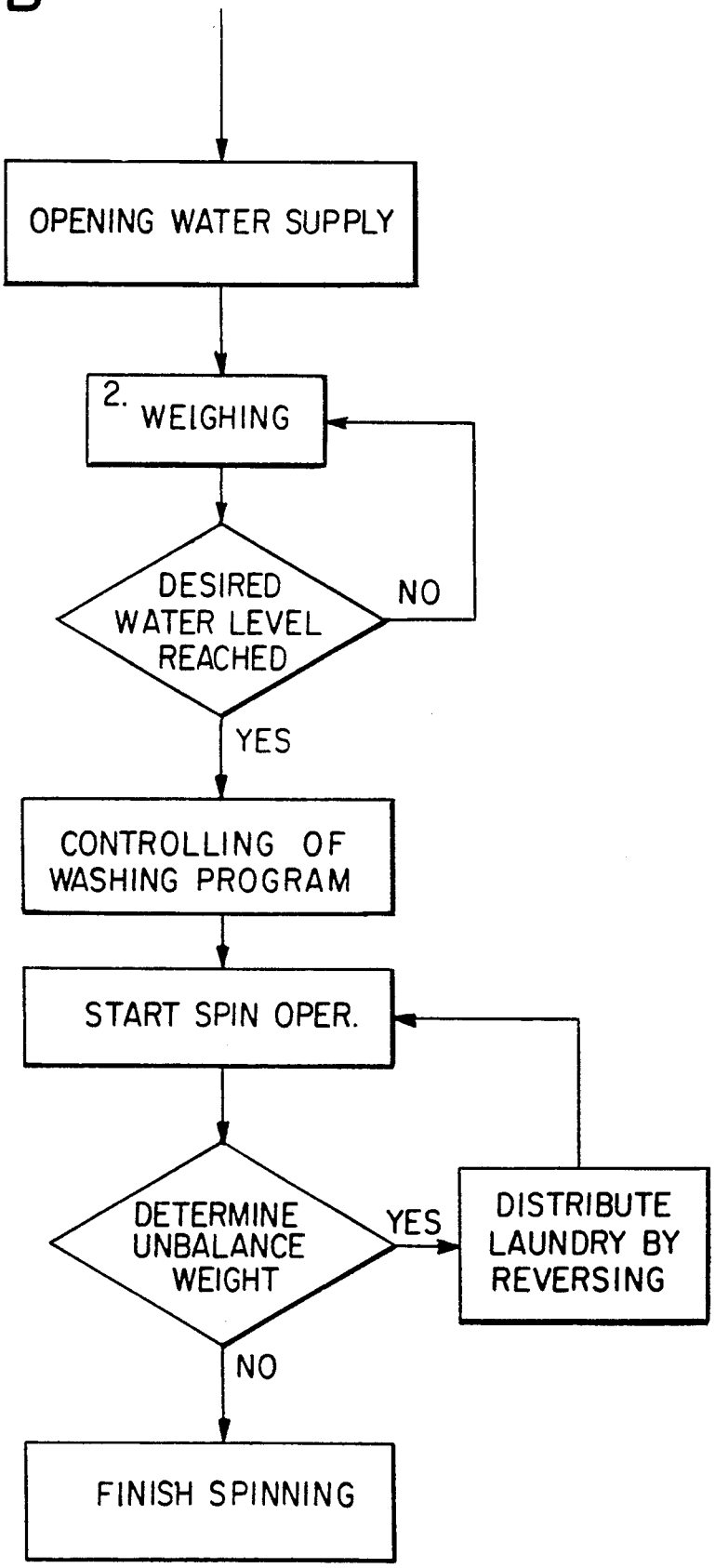

The operational sequence of an entire washing-machine control may then be designed in the manner of the embodiment illustrated in FIGS. 7A and 7B by way of a flow diagram (functional sequence). According to this diagram, switching-on of the machine at the functional block 1 first leads to the usual status checkup, i.e. initialization of the values and reset at the functional block II.

Thereafter, an indication "ready to be filled" appears, and the laundry is filled in by the operator. At this point, relevant information regarding the type of laundry, for example white linen, wool or colored linen, or the like, or relating to the degree of dirtiness, may be provided, if desired and if not implied by the selected program. Upon completion of the filling operation, a first weighing process (1st weighting process) is initiated for determining the weight of the laundry. The laundry weight so determined, the internal information regarding the type of laundry and another internal information relating for example to the desired program, are then employed by the microprocessor for calculating the desired water level, making use if required of values stored in an EPROM, for example, and for actuating the water supply control. At the same time, the microprocessor may determine the quantity of detergent required for a perfect washing operation. The desired detergent quantity can then be taken from a detergent supply which must be replenished occasionally.

The water supply control then opens the electromagnetic solenoid valve for the water supply, and the water quantity by which the desired water level can be reached, is determined by a differential measuring process.

Once the desired water quantity has been filled in, the supply valve is closed and the washing program is controlled as usual. There is no necessity to describe the functional sequence of FIGS. 7A and 7B in more detail as the lettering of the functional blocks representing the individual steps of the program describes the latter with sufficient clarity.

It is understood that the employed components or the entire central control, especially as regards the electronic control, may be based on analog, digital or hybrid technology, or may comprise, in fully or partially integrated form, corresponding portions of program-controlled digital systems, for example of the employed microprocessor, microcomputer, or the like. Another preferred application of the present invention is seen in the fact that the weighing system anyway provided can be used also in a washing-machine of the described type for managing the imbalance problem. Heretofore, any imbalance phenomena provoked in the drum by the high rotary speed during the spinning operation, as a result of some irregular distribution of the content of the drum, had to be determined either by mechanical switches or by electric measurements of the motor current, which indicated the existence of imbalance trouble in the drum connected to the electric drive motor, for example by pulsation of the current. However, such measuring methods, being always indirect methods, are always connected with corresponding inaccuracies.

By including measurements of forces, effected by means of suitable scales, it is now possible to determine directly the deflection forces caused by a rotating drum in the presence of imbalance conditions, and to take corresponding remedial measures when predetermined threshold values are exceeded, which measures may for example include stopping of the machine, re-starting or reversing of the direction of motion, in order to achieve better distribution of the content in the drum, and the like.

It should be finally noted that the claims and in particular the main claim are intended as attempts at formulating the invention, without comprehensive knowledge of the state of the prior art, so that they should not be interpreted as limiting the invention. Rather, it is understood that all the features described in the specification, the claims and the drawing may be regarded as essential to the invention either individually or in any combination thereof and may also be specified in the claims, and that the features contained in the main claim may also be reduced.

I claim:

1. In a machine for treating laundry, said machine being of the type including a drum mounted for rotation inside a housing resting on a stationary supporting surface, and weight sensor means responsive to variations of the weight of the drum, for at least one of (i) measurement of the weight of the laundry, (ii) subsequent determination of the quantities of treatment agents to be filled in (water, detergents, or the like), (iii) determining the relative humidity content of the laundry in dryers, and (iv) detecting and removing imbalance conditions occurring during spinning operations in washing-machines, or the like, the improvement comprising:

a decoupling frame arranged at least partially within the housing and in spaced relationship thereto, substantially the entire inner system of the machine being mounted to the decoupling frame, and means for resiliently mounting the decoupling frame in the housing, at least one of the weight sensor means being responsive to relative movements between the decoupling frame and the housing caused by weight variations occurring in the decoupling frame.

2. A machine for treating laundry according to claim 1, wherein the decoupling frame is suspended on the housing by means of spaced leaf springs.

3. A machine for treating laundry according to claim 1, wherein the decoupling frame is supported in the housing only on one side, by means of leaf springs arranged at different vertical heights.

4. A machine for treating laundry according to claim 3, wherein the at least one weight sensor means is a resistance strain gauge arranged on one of the leaf springs.

5. A machine for treating laundry according to claim 4 wherein said at least one weight sensor means are arranged on each of the leaf springs.

6. A machine for treating laundry according to claim 2, wherein at least one of the weight sensor means is a resistance strain gauge arranged on one of the leaf springs.

7. A machine for treating laundry according to claim 6 wherein said at least one weight sensor means are arranged on each of the leaf springs.

8. A machine for treating laundry according to claim 7, wherein the at least one weight sensor means is one of an electromechanical transducer, piezoelectric pressure pickup, a moving-coil arrangements, a string balance, and an inductive or capacitive proximity sensor.

9. A machine for treating laundry according to claim 1, wherein the decoupling frame is a closed rectangular frame constituted by profiled sections, in which a lye tank is suspended in an elastically resilient way.

10. A machine for the treatment of laundry according to claim 1, wherein the decoupling frame is an open structure of carrier elements on which the components of the machine are suspended or supported.

11. A machine for treating laundry, according to claim 1 wherein the decoupling frame comprises at least a rear wall, a bottom wall, and a front wall, the full surface of which is inserted into an open front area of the housing in such a way that clearance is obtained on all sides.

12. A machine for treating laundry, according to claim 1 wherein a door providing access to a drum is fastened to one of: (a) a lye tank enclosing the drum; and (b) a machine front formed by the decoupling frame, and the door comprises a rubber seal sealing at least one of the lye container and the drum to the outside.

13. A machine for treating laundry according to claim 1, wherein at least one of fresh water and detergent to be washed in by the water are supplied from a stationary detergent container, which is mounted on the housing, via an air gap to a funnel-structure coupled to the decoupling frame.

14. A machine for treating laundry according to claim 13, further comprising means for determining the quantity of detergent to add to the machine in response to said at least one weight sensor means and means for introducing the detergent, including a mechanical metering device.

15. A machine for treating laundry according to claim 1, wherein separate (multi-chamber) detergent containers are provided which are controlled by a central control means to supply detergents, washing powder, fabric softeners, and the like, to a funnel structure mounted to the decoupling frame, via an air gap, until the actual value determined by a weight measurement performed by said at least one weight sensor conforms to a predetermined detergent quantity, whereupon the further supply is stopped.

16. A machine for treating laundry according to claim 1, wherein during supply of hot drying air to the drum the relative variation in weight resulting from the evaporation of water is measured successively by measurements performed at predetermined intervals, conclusions as to the remaining humidity content in the laundry being dried are derived from the curve shape of the degree of evaporation, and the drying process is interrupted when a predetermined desired value is reached.

17. A machine for treating laundry according to claim 1, wherein imbalance conditions are detected on the basis of dynamic variations in weight and an ongoing spinning operation is interrupted and/or the distribution of the laundry in the drum is improved by short drum rotation cycles, including reversing movements, when a comparison with pre determined threshold values shows that the latter have been exceeded, whereupon the spinning process is restarted and/or an alarm is emitted.

* * * * *